US007449075B2

(12) United States Patent
Woodfield et al.

(10) Patent No.: US 7,449,075 B2
(45) Date of Patent: Nov. 11, 2008

(54) METHOD FOR PRODUCING A BETA-PROCESSED ALPHA-BETA TITANIUM-ALLOY ARTICLE

(75) Inventors: Andrew Philip Woodfield, Cincinnati, OH (US); Wesley Douglas Pridemore, West Chester, OH (US); Bernard Harold Lawless, West Chester, OH (US); Nancy Ann Sullivan, Williamsburg, OH (US); Peter Wayte, Maineville, OH (US); Michael James Weimer, Loveland, OH (US); Thomas Froats Broderick, Greenville, SC (US)

(73) Assignee: General Electric Company, Schenectady, NY (US)

( * ) Notice: Subject to any disclaimer, the term of this patent is extended or adjusted under 35 U.S.C. 154(b) by 473 days.

(21) Appl. No.: 10/878,105

(22) Filed: Jun. 28, 2004

(65) Prior Publication Data

US 2005/0284549 A1 Dec. 29, 2005

(51) Int. Cl.
*C22F 1/18* (2006.01)

(52) U.S. Cl. ..... 148/671; 148/421

(58) Field of Classification Search ..... 148/671
See application file for complete search history.

(56) References Cited

U.S. PATENT DOCUMENTS

| | | | | |
|---|---|---|---|---|
| 2,974,076 | A * | 3/1961 | Vordahl | 148/671 |
| 3,151,003 | A * | 9/1964 | Vordahl | 148/407 |
| 3,489,617 | A * | 1/1970 | Wuerfel | 148/670 |
| 3,649,259 | A * | 3/1972 | Heitman | 420/420 |
| 3,901,743 | A * | 8/1975 | Sprague et al. | 148/669 |
| 4,309,226 | A * | 1/1982 | Chen | 148/671 |
| 4,842,652 | A | 6/1989 | Smith et al. | |
| 5,795,413 | A | 8/1998 | Gorman | |
| 6,127,044 | A | 10/2000 | Yamamoto et al. | |
| 6,332,935 | B1 | 12/2001 | Gorman et al. | |
| 6,536,110 | B2 | 3/2003 | Smith et al. | |

OTHER PUBLICATIONS

Davis et al., ASM Handbook, 1993, ASM International, vol. 2, 603-604 and 611-612.*
Davis et al., ASM Handbook, 1995, ASM International, vol. 4, 916-918.*
The ASM Handbook (Davis et al.), Specific Metals and Alloys, Oct. 31, 1993, vol. 2, p. 598.*
The ASM Handbook (Davis et al.), Wrought Titanium and Titanium Alloys, Oct. 31, 1993, vol. 2, p. 619.*

* cited by examiner

*Primary Examiner*—John P. Sheehan
*Assistant Examiner*—Jessee R. Roe
(74) *Attorney, Agent, or Firm*—McNees Wallace & Nurick LLC

(57) ABSTRACT

A titanium-alloy article is produced by providing a workpiece of an alpha-beta titanium alloy having a beta-transus temperature, and thereafter mechanically working the workpiece at a mechanical-working temperature above the beta-transus temperature. The mechanically worked workpiece is solution heat treated at a solution-heat-treatment temperature of from about 175° F. below the beta-transus temperature to about 25° F. below the beta-transus temperature, quenched, overage heat treated at an overage-heat-treatment temperature of from about 400° F. below the beta-transus temperature to about 275° F. below the beta-transus temperature, and cooled from the overage-heat-treatment temperature.

2 Claims, 4 Drawing Sheets

METHOD FOR PRODUCING A BETA-PROCESSED ALPHA-BETA TITANIUM-ALLOY ARTICLE

This invention relates to the production of alpha-beta titanium-alloy articles that are beta processed, and more particularly to improving the isotropy of the mechanical properties of the article.

BACKGROUND OF THE INVENTION

Beta-processed alpha-beta titanium alloys are used to manufacture aerospace hardware such as components of gas turbine engines. These alloys have excellent mechanical properties relative to their weight, at both room temperature and moderate elevated temperatures as high as about 1200° F. The alloys are used to make parts such as fan and compressor disks, blisks, blades, shafts, and engine mounts.

An alpha-beta titanium alloy is an alloy having more titanium than any other element, and which forms predominantly two phases, alpha phase and beta phase, upon heat treatment. In titanium alloys, alpha ($\alpha$) phase is a hexagonal close packed (HCP) phase thermodynamically stable at lower temperatures, beta ($\beta$) phase is a body centered cubic (BCC) phase thermodynamically stable at higher temperatures above a temperature termed the "beta transus" temperature that is a characteristic of the alloy composition, and a mixture of alpha and beta phases is thermodynamically stable at intermediate temperatures. Processing to control the relative amounts and the morphologies of these phases is used to advantage in achieving the desired properties of interest in the alloys.

One approach to preparing articles is to cast the alpha-beta titanium alloy as an ingot, to thereafter thermomechanically work the workpiece from the as-cast ingot form to approximately the final shape and size of the desired article, and to thereafter final machine the article. In beta processing, the workpiece is mechanically worked, typically by forging, at a temperature above the beta-transus temperature, and subsequently heat treated at lower temperatures to reach the desired microstructure. Beta processing is particularly useful for manufacturing large articles, because the strength of the workpiece is reduced above the beta transus temperature, and large workpieces may be mechanically worked more easily in the available metalworking equipment.

In some beta-processed alpha-beta titanium alloys, the ductility of the final article is highly anisotropic and thence strongly dependent upon the angle of the principal loading direction relative to the orientation of the prior beta grain flow that occurs during the beta-phase processing. For example, the tensile ductility measured parallel to the prior beta grain flow direction may be 2-4 times larger than the ductility measured at 45 degrees to the prior beta grain flow direction. This variability in ductility may render the material unsuitable for applications where the article is mechanically loaded in different directions in different portions of the article.

There is a need for an approach to achieving desirable mechanical properties of the beta-processed alpha-beta titanium alloys but also avoiding the anisotropy in ductility and possibly other properties that is associated with some of the beta-processed alpha-beta titanium alloys. The present invention fulfills this need, and further provides related advantages.

SUMMARY OF THE INVENTION

The present approach provides a new production procedure for beta-processing alpha-beta titanium alloys. The approach produces good mechanical properties in the final articles, while also reducing the anisotropy in ductility that is a drawback of prior processing. The technique is practiced with existing production equipment.

A method for producing a titanium-alloy article comprises the steps of providing a workpiece of an alpha-beta titanium alloy having a beta-transus temperature, and thereafter mechanically working the workpiece at a mechanical-working temperature above the beta-transus temperature. Examples of alpha-beta titanium alloys that may be processed by the present approach include alloys having a nominal composition in weight percent of Ti-6Al-2Sn-4Zr-2Mo, sometimes known as Ti-6242; Ti-6Al-2Sn-4Zr-6Mo, sometimes known as Ti-6246; Ti-6Al-2Sn-2Zr-2Mo-2Cr-0.25Si, sometimes known as Ti-6-22-22S; and Ti-5Al-4Mo-4Cr-2Sn-2Zr, sometimes known as Ti-17. The workpiece may be a precursor of a component of a gas turbine engine. A mechanical working technique of particular interest is forging.

The workpiece is thereafter solution heat treated at a solution-heat-treatment temperature of from about 175° F. to about 25° F. below the beta-transus temperature, and quenched from the solution-heat-treatment temperature. In one processing embodiment, the workpiece is solution heat treated at the solution-heat-treatment temperature of from about 175° F. to about 125° F. below the beta-transus temperature. In another processing embodiment, the workpiece is solution heat treated at the solution-heat-treatment temperature of from about 100° F. to about 25° F. below the beta-transus temperature. The method includes thereafter, overage heat treating the workpiece at an overage-heat-treatment temperature of from about 400° F. to about 275° F. below the beta-transus temperature, and cooling the workpiece from the overage-heat-treatment temperature.

After the heat treating is complete, the workpiece may be further processed, as by machining, or it may be placed into service.

In a related approach, a method for producing a titanium-alloy article comprises the steps of providing a workpiece of an alpha-beta titanium alloy having a beta-transus temperature, and thereafter mechanically working the workpiece at a mechanical-working temperature above the beta-transus temperature. The method further includes solution heat treating the workpiece at a solution-heat-treatment temperature of from about 1450° F. to about 1600° F., quenching the workpiece from the solution-heat-treatment temperature, and thereafter overage heat treating the workpiece at an overage-heat-treatment temperature of from about 1225° F. to about 1350° F., and cooling the workpiece from the overage-heat-treatment temperature. In subranges of interest, the solution-heat-treatment temperature may be from about 1450° F. to about 1500° F., or from about 1525° F. to about 1600° F. Compatible features described elsewhere may be used in relation to this embodiment of the invention as well.

In a particularly preferred embodiment, a method for producing a titanium-alloy article comprises the steps of providing a workpiece of an alpha-beta titanium alloy having a beta-transus temperature and having a nominal composition in weight percent of Ti-5Al-4Mo-4Cr-2Sn-2Zr, wherein the workpiece is a precursor of a component of a gas turbine engine. The workpiece is thereafter mechanically worked at a mechanical-working temperature above the beta-transus temperature. The method further includes thereafter solution heat treating the workpiece at a solution-heat-treatment temperature of from about 1450° F. to about 1600° F., and quenching the workpiece from the solution-heat-treatment temperature, and thereafter overage heat treating the workpiece at an overage-heat-treatment temperature of from about 1225° F. to about 1350° F., and cooling the workpiece from the overage-heat-treatment temperature.

In a related approach, a method for producing a titanium-alloy article comprises the steps of providing a workpiece of an alpha-beta titanium alloy having a beta-transus temperature, thereafter mechanically working the workpiece at a mechanical-working temperature above the beta-transus temperature, thereafter solution heat treating the workpiece at a solution-heat-treatment temperature below the beta-transus temperature, and quenching the workpiece from the solution-heat-treatment temperature; and thereafter precipitation heat treating the workpiece at a temperature of from about 1100° F. to about 1225° F. The workpiece is utilized by machining the workpiece or using the workpiece in service. The workpiece is thereafter overage heat treated at an overage-heat-treatment temperature of from about 400° F. to about 275° F. below the beta-transus temperature, and cooled from the overage-heat-treatment temperature. Optionally, after the step of utilizing and before the step of overaging, the workpiece is second solution heat treated at a second solution-heat-treatment temperature of from about 175° F. to about 25° F. below the beta-transus temperature, and quenched from the second solution-heat-treatment temperature. Any contamination resulting from these heat treatments may be removed with a macro-etch or by machining. These post-processing or post-service heat treatments restore the properties of the article.

The present approach produces acceptable mechanical properties of the beta-processed alpha-beta titanium alloys, while reducing the anisotropy of ductility in the final article. The processing may be performed using existing apparatus, and does not require a change in the beta processing. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIGS. 4-5 are at a lower magnification and FIGS. 6-9 are at a higher magnification.

DETAILED DESCRIPTION OF THE INVENTION

Figure 1:
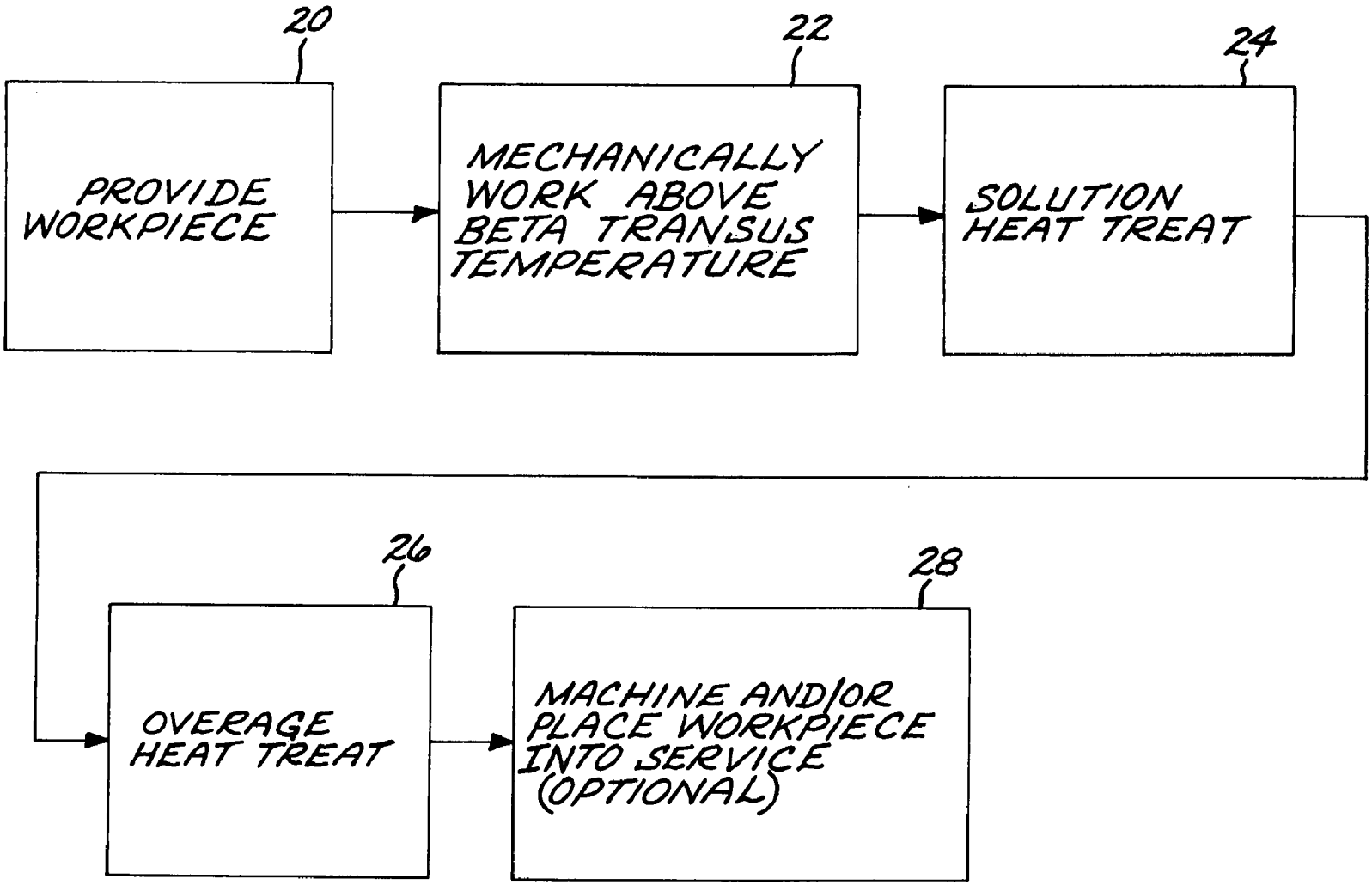
FIG. 1 is a block flow diagram of a first embodiment for practicing the method of the invention.
Figure 2:
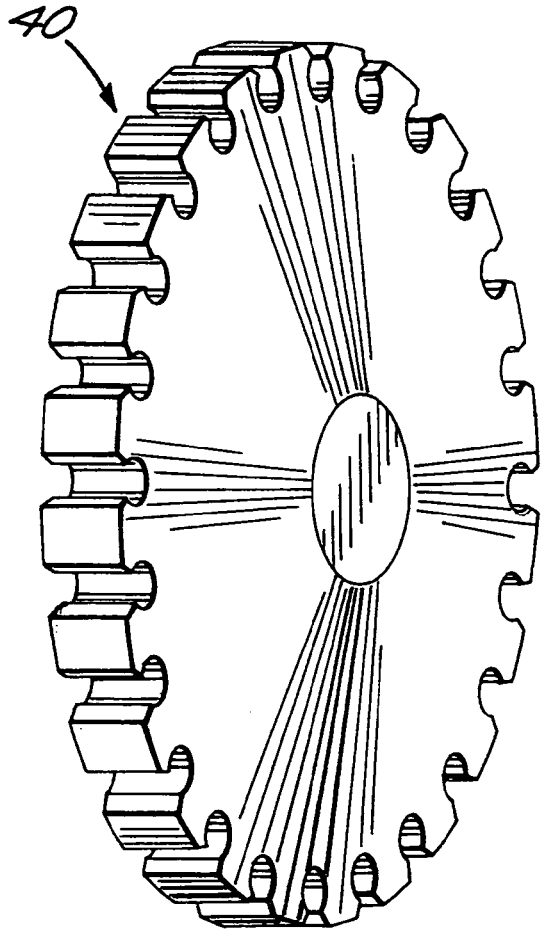
FIG. 2 is a perspective view of an article produced by the present approach.

FIG. 1 depicts a first embodiment of a method for producing a titanium-alloy article. The present approach may be used to process a wide variety of physical forms of workpieces to produce a wide variety of final articles 40. FIG. 2 illustrates one such article 40 of particular interest, a component of an aircraft gas turbine engine, and specifically an alpha-beta titanium alloy compressor disk. Other types of articles include, for example, fan disks, blades, blisks, shafts, mounts, and cases. The present approach is not limited to the producing of such articles, however.

Referring to FIG. 1, a workpiece of an alpha-beta titanium alloy having a beta-transus temperature is provided, step 20. The usual approach is to provide the workpiece by casting the alpha-beta titanium alloy from the melt. However, non-cast workpieces, such as powder-processed workpieces or non-melted workpieces, may be used instead. The workpiece (and thence the final article 40) may be made of any operable alpha-beta titanium alloy. One such alpha-beta titanium alloy of particular interest has a nominal composition in weight percent of Ti-5Al-4Mo-4Cr-2Sn-2Zr, sometimes termed Ti-17. This standard abbreviated form means that the alloy has a nominal composition of 5 weight percent aluminum, 4 weight percent molybdenum, 4 weight percent chromium, 2 weight percent tin, 2 weight percent zirconium, balance titanium and impurities. Because Ti-17 is the alloy of most interest, the following discussion will focus on the present invention as applied to the processing of a Ti-17 article. Some other examples of alpha-beta titanium alloys of interest have a nominal composition in weight percent of Ti-6Al-2Sn-4Zr-2Mo, sometimes known as Ti-6242; Ti-6Al-2Sn-4Zr-6Mo, sometimes known as Ti-6246; and Ti-6Al-2Sn-2Zr-2Mo-2Cr-0.25Si, sometimes known as Ti-6-22-22S. The use of the present approach is not limited to these alloys, however.

Figure 3:
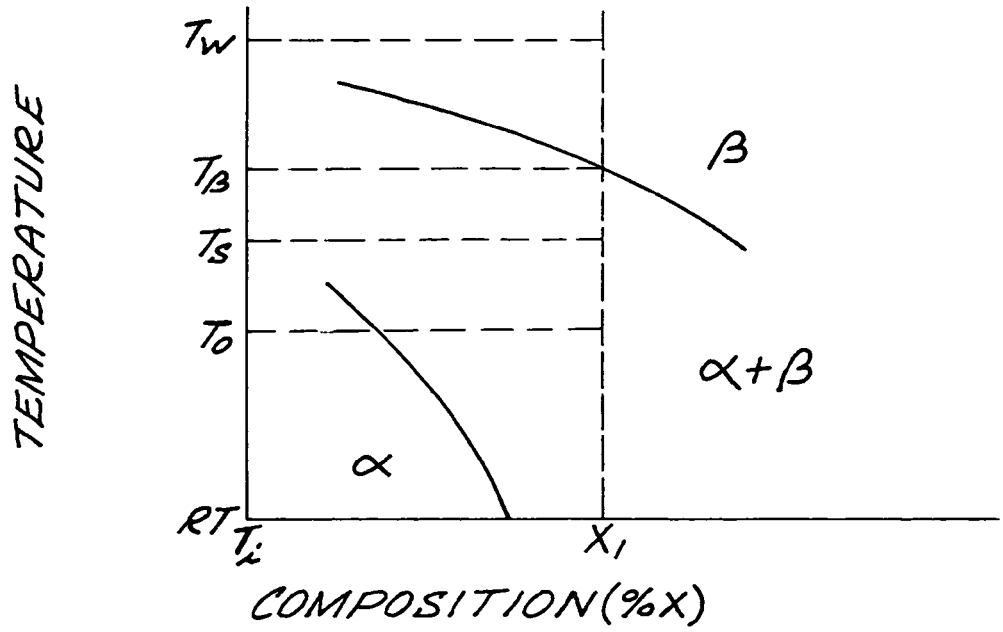
FIG. 3 is a schematic depiction of the relevant portion of the equilibrium phase diagram of the alpha-beta titanium alloy.

FIG. 3 schematically depicts the relevant portions of a temperature-composition equilibrium phase diagram for such an alpha-beta titanium alloy. (There are other features to the left and to the right of the indicated region in FIG. 3, but these are not pertinent to the present discussion and are omitted to avoid confusion.) "X" may be any element or combination of elements added to titanium to produce such a phase diagram having the alpha ($\alpha$), beta ($\beta$), and alpha-beta ($\alpha+\beta$) phase fields. The line separating the beta phase field from the alpha-beta phase field is termed the "beta transus", and the line separating the alpha-beta phase field from the alpha phase field is termed the "alpha transus". A specific alloy composition of interest is indicated as composition $X_1$. The beta transus temperature for alloy $X_1$ is $T_\beta$, and the alpha transus temperature for alloy $X_1$ is $T_\alpha$. However, for most practical alpha-beta titanium alloys $T\alpha$ is below room temperature (RT), and is not illustrated in FIG. 3. The phase diagram of FIG. 3 will be referenced in the subsequent discussions regarding the processing steps.

Figure 4:
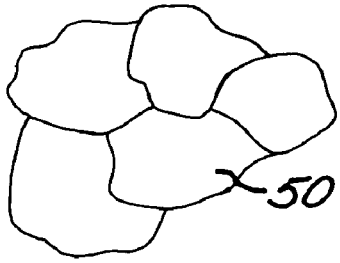
FIGS. 4-9 are a series of schematic depictions of the metallurgical microstructure of the workpiece at various stages of the processing of FIG. 1, where
Figure 5:
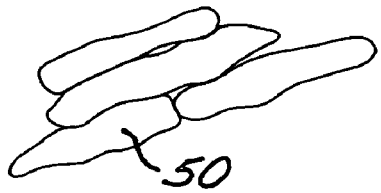
Figure 6:
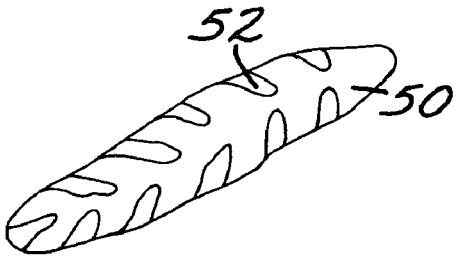

The workpiece is thereafter mechanically worked, step 22, at a mechanical-working temperature $T_W$ above the beta-transus temperature $T_\beta$. In an approach of particular interest, the workpiece is forged at the mechanical-working temperature $T_W$. FIGS. 4-5 depict the metallurgical microstructure of the workpiece at low magnifications, with FIG. 4 showing the as-cast material provided in step 20, and FIG. 5 showing the mechanically worked material at the conclusion of step 22. The mechanical working causes the beta grains 50 of the workpiece to elongate parallel to the working direction, which is the beta grain flow discussed earlier. Upon cooling, coarse platelets of alpha phase 52 precipitate within the prior beta grains 50, as depicted in FIG. 6, which is at a higher magnification than FIGS. 4-5 and shows a single prior beta grain 50 with the alpha-phase precipitate platelets 52 therein. In this precipitation of the coarse alpha phase 52, at some point the beta phase around the growing alpha phase becomes supersaturated, and the plates of coarse alpha phase 52 stop growing. This elongated beta-phase grain structure of the alpha-beta alloys of interest, when subsequently processed in accordance with prior procedures, results in the undesirable anisotropy in some properties such as ductility.

In the present approach as depicted in FIG. 1, the mechanically beta worked workpiece is thereafter solution heat treated, step 24, at a solution-heat-treatment temperature $T_S$ (see FIG. 3) of from about 175° F. to about 25° F. below the beta-transus temperature, typically for a time of about 4 hours. In a typical case of heat treating Ti-17 and similar alloys, the solution treatment temperature $T_S$ is from about 1450° F. to about 1600° F. Two embodiments of this step are of interest. In the first embodiment, $T_S$ is from about 175° F. to about 125° F. below the beta-transus temperature, or from about 1450° F. to about 1500° F., preferably about 1475° F. for Ti-17 and similar alloys. In the second embodiment, $T_S$ is from about 100° F. to about 25° F. below the beta-transus temperature, or from about 1525° F. to about 1600° F. for Ti-17 and similar alloys. The second embodiment produces a higher volume fraction of beta phase 54 in the solution heat treated workpiece of step 24, with greater hardening potential, as compared with the first embodiment. In the solution heat treating step 24, there is some resolution of the coarse alpha phase 52 with a reduction in its volume fraction.

Figure 7:
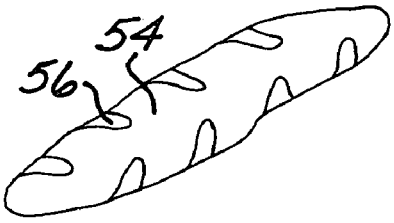

At the completion of the solution treating step 24, the workpiece is quenched from the solution-heat-treatment temperature $T_S$, such as by water quenching to room temperature. The solution treating and quenching establish the relative amounts of the beta phase 54 and the alpha phase 56, as shown in FIG. 7.

The workpiece is overage heat treated, step 26, at an overage-heat-treatment temperature $T_O$ of from about 400° F. to about 275° F. below the beta-transus temperature, and cooled from the overage-heat-treatment temperature. In the case of Ti-17 and similar alloys, the overage-heat-treatment temperature $T_O$ is from about 1225° F. to about 1350° F.

Figure 8:
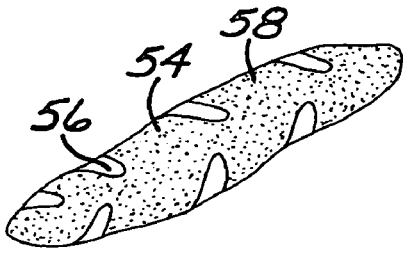
Figure 9:
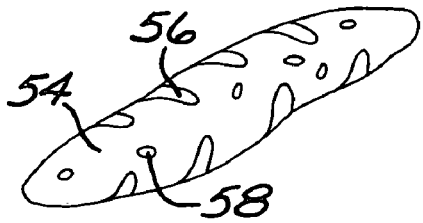

During the quenching of Ti-17 from the solution treating step 24 and the initial portion of the overage heat treatment step 26, fine secondary alpha phase 58 is precipitated in the beta phase 54, as shown in FIG. 8. After further aging in step 26, the secondary alpha phase 58 coarsens, as shown in FIG. 9, and the volume fraction of beta phase 54 increases. Subsequent cooling from the overage-heat-treatment temperature $T_O$ has been found not to result in significant re-precipitation of fine secondary alpha phase over intermediate cooling rate of about 2-20° F. per minute. This microstructure has been shown to be stable against subsequent thermal exposures in service, and it is expected that the structure is stable up to the maximum operating temperature of the alpha-beta alloys. This microstructure in Ti-17 produces a yield strength of about 140,000-160,000 pounds per square inch, and the ductility is typically relatively isotropic, an important advantage in many applications such as the manufacture of gas turbine compressor disks. The relatively isotropic yield strength of about 140,000-160,000 pounds per square inch is significantly greater than the yield strength of about 130,000 pounds per square inch that is usually found in thick-section Ti-6Al-4V material.

By comparison, in conventional processing overaging is performed at a temperature of from about 1120° F. to about 1200° F. This lower overaging temperature produces a high yield strength of about 148,000-173,000 pounds per square inch, but the ductility is significantly anisotropic. The present approach thus produces a somewhat lower yield strength than the prior processing, but the ductility produced by the present approach is more nearly isotropic than that of the prior approach.

The overage-heat-treated workpiece is thereafter optionally machined and/or placed into service, step 28. The machining is performed as needed to produce the fine-scale detail in the workpiece, such as the dovetail slots in the compressor disk article 40 of FIG. 2.

Figure 10:
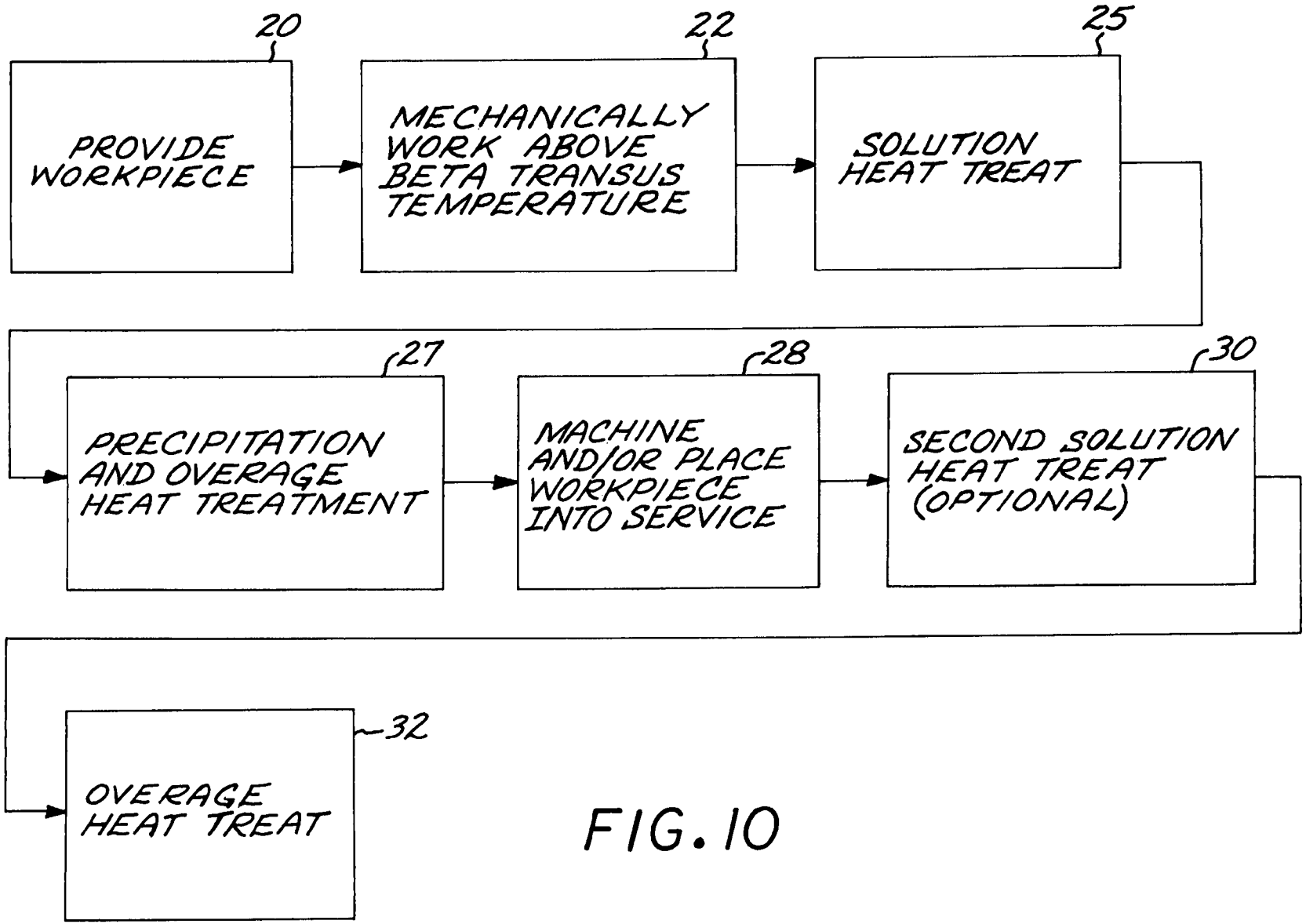
FIG. 10 is a block flow diagram of a second embodiment for practicing the method of the invention.

FIG. 10 depicts a second embodiment of the present approach. In this approach, steps 20, 22, and 28 are substantially the same as described in relation to the first embodiment of FIG. 1, and the prior description of these steps is incorporated here.

In a solution heat treating step 25 performed after the mechanical working step 22, the workpiece is solution heat treated at a solution-heat-treatment temperature below the beta-transus temperature, typically at a temperature of from about 1450° F. to about 1500° F., most preferably about 1475° F., for a time that is typically about 4 hours. The workpiece is quenched from the solution-heat-treatment temperature, typically by water quenching. Thereafter, the workpiece is precipitation and overage heat treated, step 27, at a temperature of from about 1100° F. to about 1225° F., for a time that is typically about 8 hours. After this solution-treating-and precipitating heat treatment, the workpiece is machined or placed into service, as in step 28 described previously.

At a later time, the properties, which may have degraded slightly over time in service, may be improved and restored by overage heat treating the workpiece at a second overage-heat-treatment temperature of from about 400° F. to about 275° F. below the beta-transus temperature, step 32, and cooling the workpiece from the second overage-heat-treatment temperature. If the workpiece has a critical dimension that cannot be significantly altered after the second overage-heat-treatment 32, it may be heat treated in a vacuum so as to minimize the formation of brittle alpha case. In this instance, any minor amount of alpha case or other contamination may be removed by a macroetch or an etch associated with the blue etch anodize process. (If alpha case is formed in steps 24 and 26 of the embodiment of FIG. 1, it is typically subsequently machined away, but that approach may not be available after the workpiece has been in service and if the dimension of the part is close to the minimum tolerance.)

Optionally, the workpiece is second solution heat treated at a second solution-heat-treatment temperature of from about 175° F. to about 25° F. below the beta-transus temperature, step 30, and quenched from the second solution-heat-treatment temperature. Step 30, when used, is performed after step 28 and before step 32. This second solution heat treating 30 is followed by the second overage heat treating 32 at a second overage-heat-treatment temperature of from about 400° F. to about 275° F. below the beta-transus temperature, and cooling the workpiece from the second overage-heat-treatment temperature.

The present heat treating approach has the beneficial effect of making the ductility of the article more nearly isotropic (although not perfectly isotropic). A baseline heat treatment of the Ti-17 alloy was performed with a solution heat treatment at a temperature of 1475° F. for 4 hours followed by a precipitation heat treatment at 1135° F. The mechanical properties in a radial direction of the disk were measured as a yield strength of 156,600 pounds per square inch, an ultimate tensile strength of 170,000 pounds per square inch, and a total elongation of 9.5 percent. The mechanical properties in an axial direction of the disk were measured as a yield strength of 162,200 pounds per square inch, an ultimate tensile strength of 172,800 pounds per square inch, and a total elongation of 4.2 percent. The difference in the total elongations for the two orthogonal directions was (9.5 percent−4.2 percent)=5.3 percent. In an embodiment of the present approach, the specimen was solution heat treated at 1550° F. for 4 hours followed by an overaging heat treatment at 1225° F. The mechanical properties in a radial direction of the disk were measured as a yield strength of 144,500 pounds per square inch, an ultimate tensile strength of 163,000 pounds per square inch, and a total elongation of 9.4 percent. The mechanical properties in an axial direction of the disk were measured as a yield strength of 156,600 pounds per square inch, an ultimate tensile strength of 166,800 pounds per square inch, and a total elongation of 6.9 percent. The difference in the total elongations for the two orthogonal directions was (9.4 percent−6.9 percent)=2.5 percent. The present approach thus achieved significantly more nearly isotropic ductility properties as compared with the baseline approach.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for producing a titanium-alloy article, comprising the steps of providing a workpiece of an alpha-beta titanium alloy having a beta-transus temperature; thereafter mechanically working the workpiece at a mechanical-working temperature above the beta-transus temperature; thereafter solution heat treating the workpiece at a solution-heat-treatment temperature below the beta-transus temperature, and quenching the workpiece from the solution-heat-treatment temperature; thereafter precipitation heat treating the workpiece at a temperature of from about 1100° F. to about 1225° F.; thereafter utilizing the workpiece by machining the workpiece or using the workpiece in service; thereafter second solution heat treating the workpiece at a second solution-heat-treatment temperature of from about 175° F. below the beta-transus temperature to about 25° F. below the beta-transus temperature, and quenching the workpiece from the second solution-heat-treatment temperature; and thereafter overage heat treating the workpiece at an overage-heat-treatment temperature of from about 400° F. below the beta-transus temperature to about 275° F. below the beta-transus temperature, and cooling the workpiece from the overage-heat-treatment temperature.

2. A method for producing a titanium-alloy article, comprising the steps of providing a workpiece of an alpha-beta titanium alloy having a beta-transus temperature; thereafter mechanically working the workpiece at a mechanical-working temperature above the beta-transus temperature; thereafter solution heat treating the workpiece at a solution-heat-treatment temperature below the beta-transus temperature, and quenching the workpiece from the solution-heat-treatment temperature; thereafter precipitation heat treating the workpiece at a temperature of from about 1100° F. to about 1225° F.; thereafter utilizing the workpiece by machining the workpiece or using the workpiece in service; thereafter second solution heat treating the workpiece at a second solution-heat-treatment temperature of from about 1450° F. to about 1600° F., and quenching the workpiece from the second solution-heat-treatment temperature; and thereafter overage heat treating the workpiece at an overage-heat-treatment temperature of from about 1200° F. to about 1325° F., and cooling the workpiece from the overage-heat-treatment temperature.

* * * * *